US006725852B1

(12) United States Patent
Yokota et al.

(10) Patent No.: US 6,725,852 B1
(45) Date of Patent: Apr. 27, 2004

(54) FREE-FLOWING PAINTBALL HOPPER

(75) Inventors: Michael J. Yokota, San Diego, CA (US); Joseph A. Landry, Spring Valley, CA (US); Lester Broersma, San Diego, CA (US)

(73) Assignee: JT USA, Inc., Chula Vista, CA (US)

( * ) Notice: Subject to any disclaimer, the term of this patent is extended or adjusted under 35 U.S.C. 154(b) by 0 days.

(21) Appl. No.: 10/422,420

(22) Filed: Apr. 23, 2003

(51) Int. Cl.[7] ..... F41B 11/02
(52) U.S. Cl. ..... 124/49; 124/51.1
(58) Field of Search ..... 124/49, 51.1

(56) References Cited

U.S. PATENT DOCUMENTS 5,166,457 A * 11/1992 Lorenzetti
5,947,100 A * 9/1999 Anderson
6,305,367 B1 * 10/2001 Kotsiopoulos et al.
6,418,919 B1 * 7/2002 Perrone
6,481,432 B2 * 11/2002 Rushton et al.

* cited by examiner

*Primary Examiner*—John A. Ricci
(74) *Attorney, Agent, or Firm*—Henri J.A. Charmasson; John D. Buchaca

(57) ABSTRACT

An ammunition magazine for dispensing uniformly-sized spherical projectiles such as paintballs into a gun adapted to shoot said projectiles has a generally oblong, closed container having a channel defined in its bottom from a distal axial end to an outlet port located in a lowermost, median portion of the container. The proximal portion of the container floor defines a slanted platform which extends above and beyond the outer port so that projectiles are urged by the platform toward the distal end of the channel from where they roll under the platform and into the outlet port. A helicoidal stirring arm projects from a distal area of the platform obliquely over the exposed part of the channel. The steering arm is driven by an electrical motor controlled by a switch conveniently mounted on the side of the magazine. The arm spins in a ball-uplifting direction to break any jamming of the balls above the channel. The outlet port extends into a tubular section having radial fins which allow the escape of blown-back gases between the tubular section and the internal wall of the gun projectile inlet.

11 Claims, 3 Drawing Sheets

FREE-FLOWING PAINTBALL HOPPER

FIELD OF THE INVENTION

This invention relates to ammunition magazines and more specifically to magazines for dispensing uniformly-sized spherical projectiles such as frangible paintballs into a gun adapted to shoot said projectiles.

BACKGROUND OF THE INVENTION

The ever-increasing popularity of war games in which frangible paintballs are shot to mark a living target, has prompted many improvements designed to enhance the rapid and sustained firing of a large quantity of projectiles. The most recent models of paintball guns incorporate substitutable paintball hoppers or magazines that mount above a feeding port in the upper section of the gun. These hoppers or magazines usually have a funnel-shaped floor that urge the paintball toward an outlet port located in the lowermost area of the magazine. As the magazine can hold hundreds of projectiles, their cumulative weight can cause jamming at the outlet port.

A variety of anti-jamming mechanisms has been offered by the prior art They include motor-driven disk agitators such as the one disclosed in U.S. Pat. No. 5,282,454 Bell et al.; and U.S. Pat. No. 6,305,367 Kotsiopoulos et al. Electrical vibrators such as the one disclosed in U.S. Pat. No. 6,418,919 and Publication No. US. 2002/0096163, both from Perrone have also been proposed. Some magazines feature auger-like feeding devices like the one shown in U.S. Pat. No. 6,415,781 Perrone. Almost all containers feature a concave floor as was earlier taught in U.S. Pat. No. 5,166,457 Lorenzetti. This last patent also taught the use of an incline channel in order to more effectively direct the projectiles toward the outlet port.

The instant invention results from attempts to avoid the bulky and complex feeding mechanisms of the prior art and to provide a more reliable anti-jamming approach for paintball hoppers.

SUMMARY OF THE INVENTION

The principal and secondary objects of this invention are to provide a simple, lightweight paintball hopper in which the projectiles are constantly fed to an outlet port in an orderly and jam-free operation by relying on the special geometry of the paintball container and the optional use of a simple agitator. These and other valuable objects are achieved by using a container having a generally ovoidal shape in which a channel commensurate with the size of the paintball is formed in the floor from a distal end and downwardly toward a outlet port in a median, lowermost portion of the magazine floor. The proximal half of the magazine floor defines a platform that extends above and beyond the outlet port in order to minimize competition of paintballs as they move toward the distal part of the channel from which they can conveniently roll in a single line under the distal edge of the platform and into the outlet port. A short helicoidal stirring arm can be used occasionally to release jamming of the paintballs. The arm projects obliquely and upwardly from the distal edge of the platform above the exposed part of the channel and is driven counter-clockwise, that is in a ball uplifting motion that prevents jamming by an electrical motor manually controllable by a switch mounted on the side of the hopper. The outlet port extends into a tubular section which has a series of radial fins. When the tubular section is forcedly inserted into the projectile inlet port of the gun, the fins resiliently compress to provide a close fitting regardless of any slight deviation between the mating part of the tubular section and the gun inlet port. Space between the fins provide a convenient escape for gases that may have accumulated in the inlet port of the gun. A filling port is provided in an upper portion of the container.

DESCRIPTION OF THE PREFERRED EMBODIMENT OF THE INVENTION

Figure 1:
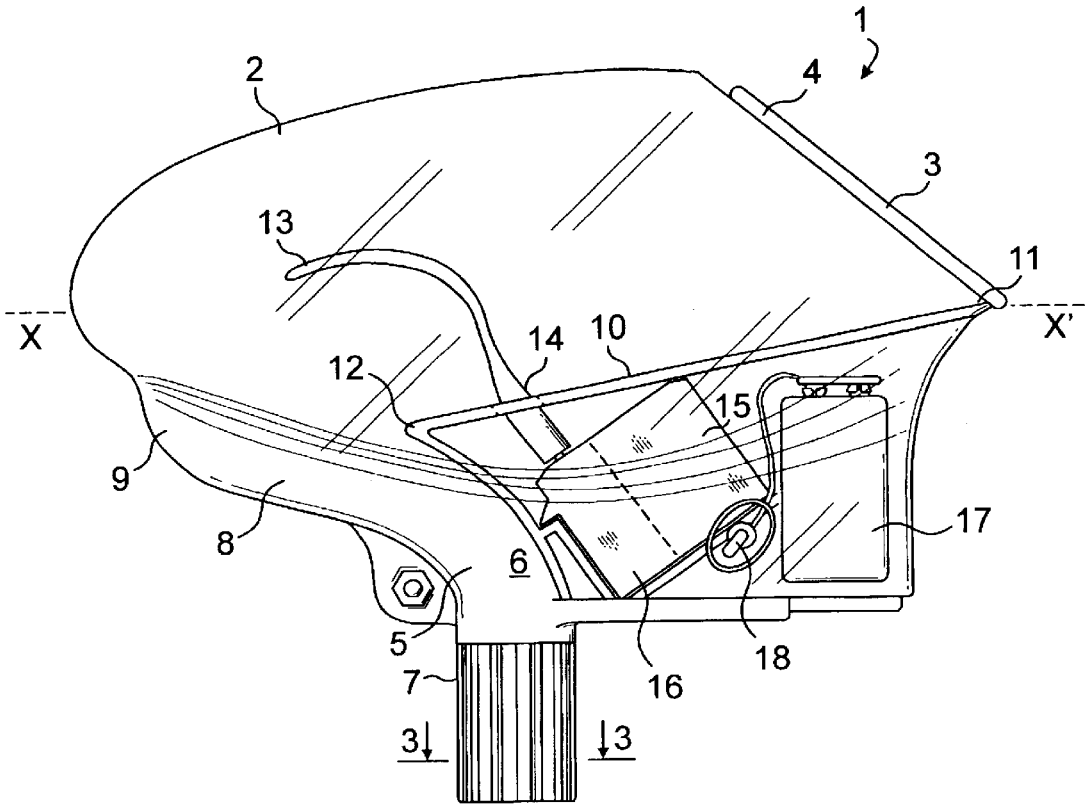
FIG. 1 is a side elevational view of the hopper according to the invention.
Figure 2:
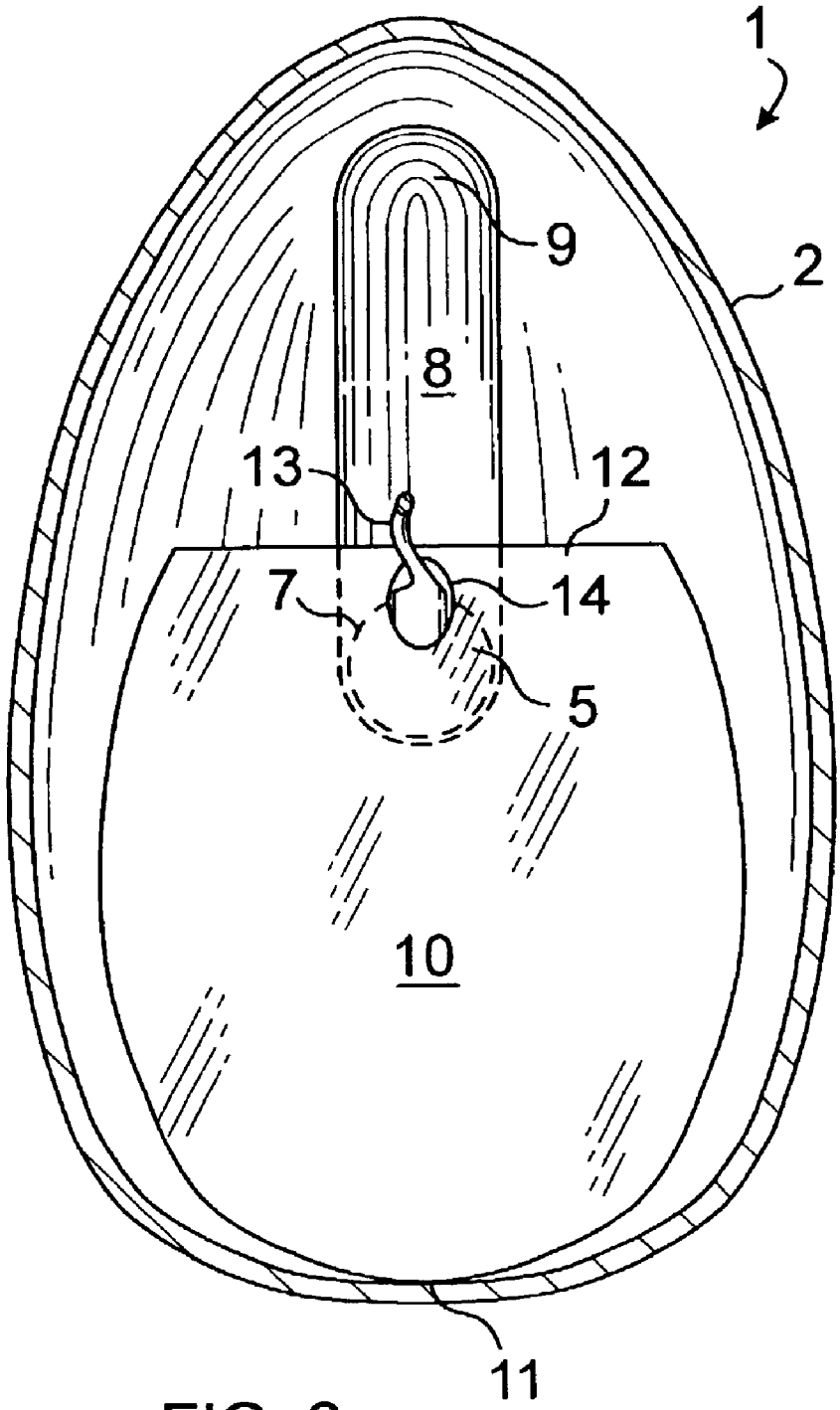
FIG. 2 is a median cross-sectional view taken along axis X–X' of FIG. 1.

Referring now to the drawing, there is shown a paintball projectile hopper or magazine 1 suitable for feeding frangible, uniformly-sized, spherical paintballs by gravity to a paintball-firing gun. The magazine comprise an ovoid container 2 made of transparent plastic material. The container has a loading aperture 3 sealed by a removable cover 4. The loading access is preferably located in the proximal upper region of the magazine facing the user of the gun. The outlet port 5 located in a median lowermost part of the container floor or bottom 6 leads into a tubular section 7 suitable for insertion into the projectile inlet of the gun. A channel 8 in the form of a trough is formed in the bottom of the container and extends from a distal portion 9 of the container axially and downwardly toward the outlet port 5. The channel 8 has a circular cross-section of a radius commensurate with that of the paintballs, and is shaped and dimensioned to accept and guide projectiles in an orderly fashion toward the outlet port 5. The proximal and median portions of the container's bottom is constituted by a flat platform 10. This portion of the bottom extends downwardly from the proximal end 11 of the container to a most distal ledge 12 which overlaps the outlet port 5. It should be noted that the median horizontal cross-section of the container taken about the axis X–X' as well as the platform 10 have generally ovoid shapes as illustrated in FIG. 2. The internal walls of the container, the channel 8 and the platform 10 have smooth surfaces that favorize the even flow of the projectiles toward the outlet port. The channel 8 has a most distal, exposed receiving section 9 followed by a downward-bending section that begins under the ledge 12 of the platform and leads to the tubular section 7 whose axis lies orthogonally to the longitudinal axis X–X' of the container. The extension of the platform 10 over and beyond the outlet port 5 and the shape of the channel 8 cooperate in leading the paintballs into an orderly alignment as they advance under the ledge 12 toward the outlet port. A stirring arm 13 forming a helicoidal blade projects obliquely and upwardly at an angle of about 45° from the vertical from an opening 14 in the distal portion of the platform and extends over part of the exposed distal portion of the channel 8. The arm spins counter-clockwise in order to lift the balls rather than forcing them down into a jamming condition into the channel 8. The arm is driven by an electrical motor 15 which is housed below the platform along with a speed-reducing gear mechanism 16 interposed between the motor and the stirrer arm. Also packaged under the platform is a battery 17 that supplies the motor. A switch 18 is mounted on the side of the hopper to allow manual control of the motor.

Figure 3:
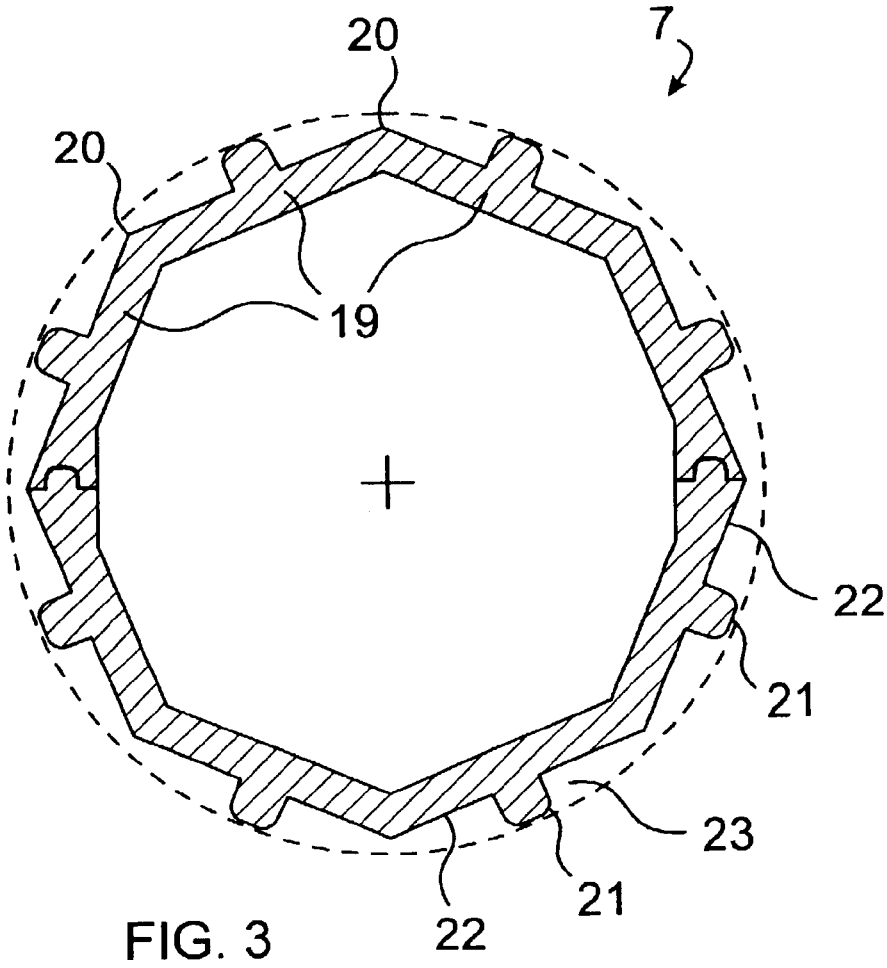
FIG. 3 is a partial cross-sectional view taken along line 3—3 of FIG. 1.

As more specifically illustrated in FIG. 3, the tubular section 7 is formed by a plurality of axially oblong, substantially planar panels 19 joined at their lateral edges 20. A series of fins 21 extend axially along the tubular section 7 of the outlet port and project radially and outwardly from the outer wall surfaces 22 of each of the panels. A fin is located in the medial portion of each panel and the tubular section is made of a bendable plastic so that it will resiliently compress when the tubular section 7 is forcedly inserted into the projectile inlet 23 of the gun. The gaps 24 between the fins provide a convenient escape for gases that may have accumulated in the gun's projectile inlet. The resilient flexibility of the tubular section also allows for the proper fitting of the hopper into gun projectile inlets of slightly different diameters.

While the preferred embodiment of the invention has been described, modifications can be made and other embodiments may be devised without departing from the spirit of the invention and the scope of the appended claims.

What is claimed is:

1. An ammunition magazine for dispensing uniformly-sized spherical projectiles by gravity into a gun adapted to shoot said projectiles said magazine comprising:

a generally oblong, closed, hollow container having an horizontal longitudinal axis, a smooth inner surface, a filling port located in an upper portion of the container and an outlet port positioned in a lowermost median portion thereof;

a channel defined in the bottom of said container and extending downwardly from an axial, distal end thereof to said outlet port;

a flat portion of said bottom extending downwardly from an axial, proximal end of the container opposite said first axial end, to an area above and beyond said outlet port;

whereby projectiles are urged by said flat portion into a receiving section of said channel nearest said distal axial end, then down said channel under a distal part of said flat portion and in a single line toward said outlet port.

2. The magazine of claim 1, wherein said outlet port comprises a bending section and a following straight tubular section substantially orthogonal to said axis.

3. The magazine of claim 2, wherein said container has a substantially ovoidal, horizontal, median cross-section.

4. The magazine of claim 2, wherein said tubular section has a plurality of fins extending axially along an external peripheral surface section thereof and projecting radially and outwardly therefrom;

said tubular section being externally dimensioned to tightly engage into a tubular projectile inlet of said gun;

whereby excess gases accumulating in said projectile inlet can escape between said fins.

5. The magazine of claim 4, wherein said fins are shaped and dimensioned to resiliently compress when said tubular section is forcedly inserted into said projectile inlet.

6. The magazine of claim 1 which further comprises a stirrer arm extending obliquely upwardly from a distal marginal area of said flat portion and over said receiving portion of the channel.

7. The magazine of claim 6, wherein said stirrer arm comprises a helicoidal blade spinnable in an uplifting direction to break jamming of said projectiles above said channel.

8. The magazine of claim 6 which further comprises an electrical motor rotatively driving said stirrer arm.

9. The magazine of claim 8 which further comprises an electrical switch for manually controlling the operation of said motor.

10. The magazine of claim 9 which further comprises a battery; and wherein said motor and said battery are housed under said flat portion of the container bottom.

11. The magazine of claim 10 which further comprises a speed-reducing gear mechanism interposed between said motor and said stirrer arm.

* * * * *